US012503289B2

(12) United States Patent
Popwell et al.

(10) Patent No.: US 12,503,289 B2
(45) Date of Patent: Dec. 23, 2025

(54) PRESSURIZED OR VACUUM-SEALED CONTACT LENS PACKAGES

(71) Applicant: JOHNSON & JOHNSON VISION CARE, INC., Jacksonville, FL (US)

(72) Inventors: Sam Jonathan Popwell, Jacksonville, FL (US); Daniel Graham Ward, Cambridge (GB); Stephen Sams, Cambridge (GB); William Stephen Honey, Bath (GB)

(73) Assignee: JOHNSON & JOHNSON VISION CARE, INC., Jacksonville, FL (US)

( * ) Notice: Subject to any disclaimer, the term of this patent is extended or adjusted under 35 U.S.C. 154(b) by 0 days.

(21) Appl. No.: 18/720,251

(22) PCT Filed: Dec. 15, 2022

(86) PCT No.: PCT/IB2022/062298
§ 371 (c)(1),
(2) Date: Jun. 14, 2024

(87) PCT Pub. No.: WO2023/111939
PCT Pub. Date: Jun. 22, 2023

(65) Prior Publication Data

US 2025/0058951 A1 Feb. 20, 2025

Related U.S. Application Data

(60) Provisional application No. 63/290,505, filed on Dec. 16, 2021.

(51) Int. Cl.
*B65D 75/32* (2006.01)
*B65D 75/36* (2006.01)

(52) U.S. Cl.
CPC ..... *B65D 75/326* (2013.01); *B65D 75/366* (2013.01); *B65D 2585/545* (2013.01)

(58) Field of Classification Search
CPC ..... B65D 75/326; B65D 75/366; B65D 2585/545
(Continued)

(56) References Cited

U.S. PATENT DOCUMENTS 3,088,830 A 5/1963 Graham
3,089,500 A 5/1963 Stalcup
(Continued)

FOREIGN PATENT DOCUMENTS

BR 202016013147 4/2019
CN 101662967 3/2010
(Continued)

OTHER PUBLICATIONS

International Search Report & Written Opinion, International Patent Application No. PCT/IB2022/062298, dated Apr. 21, 2023, 6 pages.
(Continued)

*Primary Examiner* — Jacob K Ackun
(74) *Attorney, Agent, or Firm* — Casimir Jones, S.C.; Thomas J. Lyneis

(57) ABSTRACT

The present invention relates to improved contact lens packages and methods of use and manufacture/assembly. A contact lens package may include a cavity that houses a contact lens and packaging solution. In one aspect, an absolute pressure within the cavity may be greater than standard atmospheric pressure when the package is in an unopened state. In another aspect, an absolute pressure within the cavity may be less than standard atmospheric pressure when the package is in an unopened state.

18 Claims, 4 Drawing Sheets

(58) Field of Classification Search
USPC ..... 206/528, 5.1
See application file for complete search history.

(56) References Cited

U.S. PATENT DOCUMENTS

| | | | |
|---|---|---|---|
| 3,159,308 | A | 12/1964 | Lawrence |
| 3,369,656 | A | 2/1968 | Skinner |
| 3,414,117 | A | 12/1968 | Leeds |
| 3,473,886 | A | 10/1969 | Leeds |
| 3,490,806 | A | 1/1970 | Ana |
| 3,524,455 | A | 8/1970 | Hoogesteger |
| 3,584,908 | A | 6/1971 | Ray |
| 3,977,517 | A | 8/1976 | Kadlecik et al. |
| 4,187,574 | A | 2/1980 | Wrue |
| 4,392,569 | A | 7/1983 | Shoup |
| 4,415,076 | A | 11/1983 | Campbell |
| 4,444,307 | A | 4/1984 | Jermyn |
| 4,495,313 | A | 1/1985 | Larsen |
| 4,512,601 | A | 4/1985 | Jacobstein |
| 4,659,782 | A | 4/1987 | Spinelli |
| 4,659,783 | A | 4/1987 | Spinelli |
| 4,691,820 | A | 9/1987 | Martinez |
| 4,889,664 | A | 12/1989 | Kindt-Larsen et al. |
| 4,942,959 | A | 7/1990 | Sauber |
| 4,986,414 | A | 1/1991 | Ashley et al. |
| 5,031,622 | A | 7/1991 | Lahaye |
| 5,039,459 | A | 8/1991 | Kindt-Larsen et al. |
| 5,053,208 | A | 10/1991 | Seamons |
| 5,099,987 | A | 3/1992 | Bieri |
| 5,227,039 | A | 7/1993 | Pankow |
| 5,244,981 | A | 9/1993 | Seidner et al. |
| 5,314,960 | A | 5/1994 | Spinelli |
| 5,331,067 | A | 7/1994 | Seidner et al. |
| 5,371,147 | A | 12/1994 | Spinelli |
| 5,375,698 | A | 12/1994 | Eward et al. |
| 5,407,062 | A | 4/1995 | Shannon |
| 5,415,275 | A | 5/1995 | Girimont |
| 5,452,027 | A | 9/1995 | Tylec |
| 5,474,169 | A | 12/1995 | Bauman |
| 5,515,964 | A | 5/1996 | Bauman |
| 5,609,246 | A | 3/1997 | Borghorst et al. |
| 5,620,088 | A | 4/1997 | Martin |
| 5,695,049 | A | 12/1997 | Bauman |
| 5,704,468 | A | 1/1998 | Lust et al. |
| 5,711,416 | A | 1/1998 | Bauman |
| 5,722,536 | A | 3/1998 | Pierce |
| 5,732,990 | A | 3/1998 | Yavitz |
| 5,760,100 | A | 6/1998 | Nicolson et al. |
| 5,776,999 | A | 7/1998 | Nicolson et al. |
| 5,789,461 | A | 8/1998 | Nicolson et al. |
| 5,849,811 | A | 12/1998 | Nicolson et al. |
| 5,853,085 | A | 12/1998 | Luttrell |
| 5,965,631 | A | 10/1999 | Nicolson et al. |
| 5,998,498 | A | 12/1999 | Vanderlaan |
| 6,010,001 | A | 1/2000 | Osborn, III |
| 6,087,415 | A | 7/2000 | Vanderlaan |
| 6,138,212 | A | 10/2000 | Cummings |
| 6,138,312 | A | 10/2000 | Cummings |
| 6,253,912 | B1 | 7/2001 | Oneill |
| 6,260,695 | B1 | 7/2001 | Tasber |
| 6,276,797 | B1 | 8/2001 | Shannon |
| 6,280,530 | B1 | 8/2001 | Pankow |
| 6,286,666 | B1 | 9/2001 | Umdasch |
| 6,289,907 | B1 | 9/2001 | Horian et al. |
| RE37,558 | E | 2/2002 | Abrams |
| 6,367,929 | B1 | 4/2002 | Maiden et al. |
| 6,401,915 | B1 | 6/2002 | Faxe |
| 6,572,165 | B2 | 6/2003 | Faxe |
| 6,822,016 | B2 | 11/2004 | Mccabe et al. |
| 6,867,245 | B2 | 3/2005 | Iwata et al. |
| 6,943,203 | B2 | 9/2005 | Vanderlaan |
| 7,086,526 | B2 | 8/2006 | Newman |
| 7,225,919 | B2 | 6/2007 | Hamilton |
| 7,247,692 | B2 | 7/2007 | Laredo |
| 7,249,848 | B2 | 7/2007 | Laredo |
| 7,275,275 | B2 | 10/2007 | Pankow |
| 7,398,877 | B1 | 7/2008 | Nelson |
| 7,410,050 | B2 | 8/2008 | Py |
| 7,426,993 | B2 | 9/2008 | Coldrey |
| 7,441,650 | B2 | 10/2008 | Tanaka |
| 7,461,740 | B2 | 12/2008 | Newman |
| 7,540,376 | B2 | 6/2009 | Mahieu |
| 7,553,880 | B2 | 6/2009 | Nicolson et al. |
| 7,666,921 | B2 | 2/2010 | Mccabe et al. |
| 7,786,185 | B2 | 8/2010 | Rathore |
| 7,819,241 | B2 | 10/2010 | Post-Smith |
| 7,832,551 | B2 | 11/2010 | Newman |
| 7,832,552 | B2 | 11/2010 | Newman |
| 7,850,002 | B2 | 12/2010 | Newman |
| 7,938,255 | B2 | 5/2011 | Newman |
| 7,956,131 | B2 | 6/2011 | Arnold |
| 8,022,158 | B2 | 9/2011 | Rathore |
| 8,104,608 | B2 | 1/2012 | Newman |
| D658,077 | S | 4/2012 | Newman |
| 8,251,205 | B2 | 8/2012 | Azera |
| 8,273,802 | B2 | 9/2012 | Laredo |
| 8,399,538 | B2 | 3/2013 | Steffan |
| 8,450,387 | B2 | 5/2013 | Mccabe et al. |
| 8,470,906 | B2 | 6/2013 | Rathore |
| 8,487,058 | B2 | 7/2013 | Liu |
| 8,507,577 | B2 | 8/2013 | Zanini |
| D690,207 | S | 9/2013 | Newman |
| 8,637,621 | B2 | 1/2014 | Iwata et al. |
| 8,703,891 | B2 | 4/2014 | Broad |
| 8,833,548 | B2 | 9/2014 | Hsieh |
| 8,881,892 | B1 | 11/2014 | Linhardt |
| 8,937,110 | B2 | 1/2015 | Alli |
| 8,937,111 | B2 | 1/2015 | Alli |
| 8,940,812 | B2 | 1/2015 | Reboul |
| 9,044,075 | B2 | 6/2015 | Linhardt |
| 9,056,878 | B2 | 6/2015 | Fujisawa |
| 9,057,821 | B2 | 6/2015 | Broad |
| 9,067,720 | B2 | 6/2015 | Howell |
| 9,095,195 | B2 | 8/2015 | Mori |
| 9,125,808 | B2 | 9/2015 | Alli |
| 9,140,825 | B2 | 9/2015 | Alli |
| 9,156,934 | B2 | 10/2015 | Alli |
| 9,170,349 | B2 | 10/2015 | Mahadevan |
| 9,206,544 | B2 | 12/2015 | Zeng et al. |
| 9,244,196 | B2 | 1/2016 | Scales |
| 9,244,197 | B2 | 1/2016 | Alli |
| 9,297,928 | B2 | 3/2016 | Molock |
| 9,297,929 | B2 | 3/2016 | Scales |
| 9,320,566 | B1 | 4/2016 | Alston et al. |
| 9,358,736 | B2 | 6/2016 | Wang |
| 9,576,609 | B2 | 2/2017 | Huang |
| 9,668,558 | B2 | 6/2017 | Clamp |
| 9,701,458 | B2 | 7/2017 | Barrows |
| D804,323 | S | 12/2017 | Harrison |
| D805,920 | S | 12/2017 | Clamp |
| 9,839,270 | B2 | 12/2017 | Howell |
| D813,537 | S | 3/2018 | Miura |
| 10,092,075 | B2 | 10/2018 | Barre |
| 10,138,042 | B2 | 11/2018 | Fawdington |
| 10,194,724 | B2 | 2/2019 | Newman |
| 10,364,082 | B2 | 7/2019 | Coon |
| 10,368,621 | B2 | 8/2019 | Barre |
| 10,463,127 | B2 | 11/2019 | Kim |
| 10,577,166 | B2 | 3/2020 | Barrows |
| 10,661,964 | B2 | 5/2020 | Tokarski |
| D899,080 | S | 10/2020 | Yasuda |
| D899,081 | S | 10/2020 | Yamamoto |
| 10,901,236 | B2 | 1/2021 | Schweizer |
| 10,926,944 | B2 | 2/2021 | Huang |
| 11,071,644 | B2 | 7/2021 | Greenwood |
| 11,077,969 | B2 | 8/2021 | Newman |
| 11,136,176 | B2 | 10/2021 | Almond |
| 11,229,266 | B2 | 1/2022 | Almond et al. |
| 11,628,998 | B2 | 4/2023 | Ho |
| 11,649,099 | B2 | 5/2023 | Ellis |
| 11,751,654 | B2 | 9/2023 | Lansing |
| 2001/0017271 | A1 | 8/2001 | Yavitz |
| 2002/0158477 | A1 | 10/2002 | Faxe |
| 2002/0163212 | A1 | 11/2002 | Py |

(56) References Cited

U.S. PATENT DOCUMENTS

| | | | | |
|---|---|---|---|---|
| 2004/0134005 | A1 | 7/2004 | Pankow | |
| 2004/0238380 | A1 | 12/2004 | Newman | |
| 2005/0087453 | A1 | 4/2005 | Mahieu et al. | |
| 2005/0103649 | A1 | 5/2005 | Vulcu et al. | |
| 2005/0218012 | A1 | 10/2005 | Tanaka et al. | |
| 2006/0201103 | A1 | 9/2006 | Tokarski et al. | |
| 2006/0213783 | A1 | 9/2006 | Tokarski | |
| 2006/0213784 | A1 | 9/2006 | Tokarski et al. | |
| 2006/0219577 | A1 | 10/2006 | Newman | |
| 2006/0260956 | A1 | 11/2006 | Stachowski | |
| 2006/0260957 | A1 | 11/2006 | Hamilton | |
| 2007/0000792 | A1 | 1/2007 | Newman et al. | |
| 2007/0164576 | A1 | 7/2007 | Kim | |
| 2008/0011619 | A1 | 1/2008 | Newman | |
| 2008/0047848 | A1 | 2/2008 | Tokarski et al. | |
| 2008/0078681 | A1 | 4/2008 | Newman | |
| 2008/0170201 | A1 | 7/2008 | Filippo | |
| 2009/0121370 | A1 | 5/2009 | Barrows | |
| 2009/0139879 | A1 | 6/2009 | Tokarski | |
| 2009/0200182 | A1 | 8/2009 | Post-Smith | |
| 2010/0048847 | A1 | 2/2010 | Broad | |
| 2010/0072082 | A1 | 3/2010 | Kang | |
| 2010/0187140 | A1 | 7/2010 | Tokarski et al. | |
| 2011/0017243 | A1 | 1/2011 | Voss | |
| 2012/0267262 | A1 | 10/2012 | Wang | |
| 2013/0091613 | A1 | 4/2013 | Meltzner | |
| 2013/0277242 | A1 | 10/2013 | Mori | |
| 2014/0001059 | A1* | 1/2014 | Hsieh | A45C 11/046 206/5.1 |
| 2014/0027462 | A1 | 1/2014 | Willat | |
| 2014/0027465 | A1 | 1/2014 | Howell et al. | |
| 2014/0246337 | A1 | 9/2014 | Newman | |
| 2014/0262844 | A1* | 9/2014 | Barre | B65D 85/00 206/5.1 |
| 2015/0014187 | A1* | 1/2015 | Gilman | A45C 11/005 206/5.1 |
| 2015/0150346 | A1 | 6/2015 | Yasuda | |
| 2015/0173474 | A1 | 6/2015 | Barrows | |
| 2016/0198825 | A1 | 7/2016 | Fawdington | |
| 2017/0172269 | A1 | 6/2017 | Lin | |
| 2018/0134475 | A1 | 5/2018 | Newman et al. | |
| 2018/0340622 | A1 | 11/2018 | Godfrey | |
| 2019/0046353 | A1 | 2/2019 | Greenwood et al. | |
| 2019/0133275 | A1 | 5/2019 | Newman | |
| 2020/0229560 | A1 | 7/2020 | Almond et al. | |
| 2020/0229561 | A1 | 7/2020 | Almond et al. | |
| 2020/0229562 | A1 | 7/2020 | Almond et al. | |
| 2020/0229563 | A1 | 7/2020 | Almond et al. | |
| 2020/0231351 | A1 | 7/2020 | Almond et al. | |
| 2020/0383440 | A1 | 12/2020 | Newman | |
| 2021/0139229 | A1 | 5/2021 | Huang | |
| 2022/0133007 | A1* | 5/2022 | Almond | B65D 75/366 206/5.1 |
| 2022/0330671 | A1 | 10/2022 | Bruchon | |
| 2022/0365368 | A1 | 11/2022 | Greenwood et al. | |
| 2023/0083028 | A1 | 3/2023 | Popwell | |
| 2023/0276917 | A1 | 9/2023 | Popwell | |

FOREIGN PATENT DOCUMENTS

| | | | |
|---|---|---|---|
| CN | 111759065 | | 10/2020 |
| DE | 4415003 | | 6/1995 |
| DE | 202006004323 | | 5/2006 |
| EP | 0269367 | | 6/1988 |
| EP | 3045071 | | 7/2016 |
| EP | 2768465 | B1 | 9/2019 |
| FR | 2712398 | | 5/1995 |
| FR | 2777360 | | 10/1999 |
| GB | 2551530 | | 12/2017 |
| JP | H01279222 | | 11/1989 |
| JP | H10313928 | | 12/1998 |
| JP | 2001046134 | | 2/2001 |
| JP | 5184925 | | 1/2013 |
| JP | 2014218255 | | 11/2014 |
| JP | 6004912 | B2 | 10/2016 |
| JP | 2016179837 | A | 10/2016 |
| JP | 6129238 | | 4/2017 |
| JP | 6129239 | | 4/2017 |
| JP | 6339322 | B2 | 5/2018 |
| KR | 100768522 | | 10/2007 |
| KR | 20080066930 | | 7/2008 |
| KR | 20080090252 | | 10/2008 |
| KR | 20090060075 | | 6/2009 |
| KR | 20100002433 | A | 1/2010 |
| KR | 101495874 | | 2/2015 |
| KR | 20160064382 | | 6/2016 |
| KR | 20190003113 | | 12/2019 |
| KR | 200490803 | | 2/2020 |
| NL | 2000268 | | 4/2008 |
| TW | 200930318 | | 7/2009 |
| TW | D159617 | | 4/2014 |
| TW | D172590 | | 12/2015 |
| WO | WO 99/21519 | | 5/1999 |
| WO | WO 2002088780 | | 11/2002 |
| WO | WO 2003022321 | | 3/2003 |
| WO | WO 2005/006062 | | 1/2005 |
| WO | WO 2005/055760 | | 6/2005 |
| WO | WO 2005073105 | | 8/2005 |
| WO | WO 2005/082721 | | 9/2005 |
| WO | WO 2006068583 | | 6/2006 |
| WO | WO 2006105179 | | 10/2006 |
| WO | WO 2008061992 | | 5/2008 |
| WO | WO 2008120954 | | 10/2008 |
| WO | WO 2009/059231 | | 5/2009 |
| WO | WO 2009069265 | | 6/2009 |
| WO | WO 2012165209 | | 12/2012 |
| WO | WO 2012168964 | | 12/2012 |
| WO | WO 2013058712 | | 4/2013 |
| WO | WO 2013/134547 | | 9/2013 |
| WO | WO 2013/136361 | | 9/2013 |
| WO | WO 2013/153582 | | 10/2013 |
| WO | WO 2014185354 | | 11/2014 |
| WO | WO 2014195588 | | 12/2014 |
| WO | WO 2015150704 | | 10/2015 |
| WO | WO 2017/137738 | | 8/2017 |
| WO | WO 2019013199 | | 1/2019 |
| WO | WO 2020/152444 | | 7/2020 |
| WO | WO 2020/152446 | | 7/2020 |
| WO | WO 2021176760 | | 9/2021 |
| WO | WO 2021/260353 | | 12/2021 |
| WO | WO 2022/054033 | | 3/2022 |
| WO | WO 2022054031 | | 3/2022 |
| WO | WO 2022123525 | | 6/2022 |

OTHER PUBLICATIONS

International Search Report and Written Opinion for International Application No. PCT/IB2022/062147, mailed Mar. 16, 2023, 12 Pages.

* cited by examiner

PRESSURIZED OR VACUUM-SEALED CONTACT LENS PACKAGES

I. BACKGROUND OF THE INVENTION

In a conventional contact lens package, the contact lens typically sits in a molded plastic base having a cavity (or "bowl") that houses the contact lens in a volume of packaging solution. As a result, the user experience for transferring a contact lens from the package to an eye generally involves the user "fishing" the contact lens out of the bowl with a finger. This process requires touching the lens multiple times, which can transfer contaminants or pathogens from the hand to the lens and ultimately to the eye. Not only is this handling experience unsanitary, but it is also unduly cumbersome, messy, and mechanically stressful to the lens, which can tear, rip, or distort when overly manipulated. Furthermore, such conventional packages generally include a plastic bowl large enough to house the contact lens and a sufficient amount of packaging solution to keep the lens submerged during storage and transit (e.g., about 0.5 to 1 mL of solution).

In view of the growing awareness of sustainability and around ocular health and the customer demand for a more convenient experience, a need has arisen for contact lens packaging that enables a less messy, more ecologically responsible, and more sanitary contact lens handling process.

II. SUMMARY

It has now been found that some or all the foregoing and related objects may be attained in a contact lens package having one or more aspects described herein. According to certain embodiments a contact lens package can include a cavity that houses a contact lens and packaging solution. In certain embodiments, a positive pressure environment may be maintained within the cavity when the package is in an unopened state. As described herein, in some embodiments, the positive pressure environment within the cavity may allow the amount of material of portions of the package surrounding the cavity to be minimized and/or the use of flexible materials for such portions while still providing sufficient protection for the contact lens. In certain embodiments, a vacuum may be maintained within the cavity when the package is in an unopened state. As described herein, in some embodiments, the vacuum within the cavity may allow the amount of packaging solution to be minimized while still maintaining sufficient hydration of the contact lens. Further, in some embodiments, the vacuum within the cavity may allow the amount of material of portions of the package surrounding the cavity to be minimized and/or the use of flexible materials for such portions while still providing sufficient protection for the contact lens. The present disclosure provides various embodiments of contact lens packages, methods of packaging a contact lens, and methods of opening a contact lens package.

In one aspect, a contact lens package is provided. The contact lens package may include a cavity that houses a contact lens and packaging solution, with an absolute pressure within the cavity being greater than standard atmospheric pressure when the package is in an unopened state.

In some embodiments, the absolute pressure within the cavity may be greater than 171 kPa when the package is in the unopened state. In some embodiments, the absolute pressure within the cavity may be within a range of about 171 kPa to about 601 kPa when the package is in the unopened state. In some embodiments, the package also may include a base and a lid connected to the base, and the cavity may be formed between the base and the lid. In some embodiments, the base and the lid may collectively surround the cavity. In some embodiments, the base and the lid may collectively define the cavity. In some embodiments, the base may be flexible, and the lid may be flexible. In some embodiments, the base may include a foil layer, and the lid may include a foil layer. In some embodiments, the base may be substantially rigid, and the lid may be flexible. In some embodiments, the lid may extend over and cover the contact lens when the package is in the unopened state, the lid may not cover the contact lens when the package is in an opened state, and the contact lens may be disposed within the cavity such that a convex surface of the contact lens faces the lid when the package is in the unopened state. In some embodiments, the package also may include a lens support disposed within the cavity, and the lens support may include a support surface that supports the contact lens within the cavity. In some embodiments, the lens support may be disposed between the base and the contact lens. In some embodiments, the lens support may be connected to the base. In some embodiments, the support surface may engage a concave surface of the contact lens. In some embodiments, the support surface may be a convex surface. In some embodiments, the lid may extend over and cover the lens support when the package is in the unopened state, and the lid may not cover the lens support when the package is in an opened state. In some embodiments, the base may be flexible, the lid may be flexible, and the lens support may be substantially rigid.

In another aspect, a contact lens package is provided. The contact lens package may include a cavity that houses a contact lens and packaging solution, with a positive pressure environment being maintained within the cavity when the package is in an unopened state.

In some embodiments, an absolute pressure within the cavity may be greater than about 171 kPa when the package is in the unopened state. In some embodiments, an absolute pressure within the cavity may be within a range of about 171 kPa to about 601 kPa when the package is in the unopened state. In some embodiments, the package also may include a base and a lid connected to the base, and the cavity may be formed between the base and the lid. In some embodiments, the base and the lid may collectively surround the cavity. In some embodiments, the base and the lid may collectively define the cavity. In some embodiments, the base may be flexible, and the lid may be flexible. In some embodiments, the base may include a foil layer, and the lid may include a foil layer. In some embodiments, the base may be substantially rigid, and the lid may be flexible. In some embodiments, the lid may extend over and cover the contact lens when the package is in the unopened state, the lid may not cover the contact lens when the package is in an opened state, and the contact lens may be disposed within the cavity such that a convex surface of the contact lens faces the lid when the package is in the unopened state. In some embodiments, the package also may include a lens support disposed within the cavity, and the lens support may include a support surface that supports the contact lens within the cavity. In some embodiments, the lens support may be disposed between the base and the contact lens. In some embodiments, the lens support may be connected to the base. In some embodiments, the support surface may engage a concave surface of the contact lens. In some embodiments, the support surface may be a convex surface. In some embodiments, the lid may extend over and cover the lens support when the package is in the unopened state, and the lid may not cover the lens support when the package is in an opened state. In some embodiments, the base may be flexible, the lid may be flexible, and the lens support may be substantially rigid.

In still another aspect, a method of packaging a contact lens is provided. The method may include disposing a contact lens and packaging solution within a cavity of the package, creating a positive pressure environment within the cavity such that an absolute pressure within the cavity is greater than standard atmospheric pressure, and enclosing the cavity such that the positive pressure environment is maintained within the cavity when the package is in an unopened state.

In some embodiments, the absolute pressure within the cavity may be within a range of about 171 kPa to about 601 kPa when the package is in the unopened state. In some embodiments, the package may include a base and a lid connected to the base, the cavity may be formed between the base and the lid, and enclosing the cavity may include connecting the lid to the base. In some embodiments, the contact lens may be disposed within the cavity such that a convex surface of the contact lens faces the lid. In some embodiments, the method also may include disposing a lens support within the cavity, with the lens support including a support surface that supports the contact lens within the cavity.

In yet another aspect, a method of opening a contact lens package is provided. The method may include holding the package, with the package including a cavity that houses a contact lens and packaging solution, and with a positive pressure environment being maintained within the cavity such that an absolute pressure within the cavity is greater than standard atmospheric pressure. The method also may include transitioning the package from an unopened state to an opened state such that the positive pressure environment is no longer maintained within the cavity, engaging the contact lens, and removing the contact lens from the package via the engagement.

In some embodiments, the absolute pressure within the cavity may be within a range of about 171 kPa to about 601 kPa when the package is in the unopened state. In some embodiments, the package may include a base and a lid connected to the base, the cavity may be formed between the base and the lid, and transitioning the package from the unopened state to the opened state may include at least partially removing the lid from the base. In some embodiments, engaging the contact lens may include engaging a convex surface of the contact lens. In some embodiments, the package may include a lens support disposed within the cavity, the lens support may include a support surface that supports the contact lens within the cavity, and removing the contact lens from the package may include removing the contact lens from the lens support.

In one aspect, a contact lens package is provided. The contact lens package may include a cavity that houses a contact lens and packaging solution, with an absolute pressure within the cavity being less than standard atmospheric pressure when the package is in an unopened state.

In some embodiments, the absolute pressure within the cavity may be less than about 91 kPa when the package is in the unopened state. In some embodiments, the absolute pressure within the cavity may be within a range of about 11 kPa to about 91 kPa when the package is in the unopened state. In some embodiments, the package also may include a base and a lid connected to the base, and the cavity may be formed between the base and the lid. In some embodiments, the base and the lid may collectively surround the cavity. In some embodiments, the base and the lid may collectively define the cavity. In some embodiments, the base may be flexible, and the lid may be flexible. In some embodiments, the base may include a foil layer, and the lid may include a foil layer. In some embodiments, the base may be substantially rigid, and the lid may be flexible. In some embodiments, the lid may extend over and cover the contact lens when the package is in the unopened state, the lid may not cover the contact lens when the package is in an opened state, and the contact lens may be disposed within the cavity such that a convex surface of the contact lens faces the lid when the package is in the unopened state. In some embodiments, the package also may include a lens support disposed within the cavity, and the lens support may include a support surface that supports the contact lens within the cavity. In some embodiments, the lens support may be disposed between the base and the lid. In some embodiments, the lens support may be connected to the base. In some embodiments, the support surface may engage a concave surface of the contact lens. In some embodiments, the support surface may be a convex surface. In some embodiments, the lens support may include a bowl comprising a bowl cavity that houses the contact lens and the packaging solution. In some embodiments, the lid may extend over and cover the lens support when the package is in the unopened state, and the lid may not cover the lens support when the package is in an opened state. In some embodiments, the base may be flexible, the lid may be flexible, and the lens support may be substantially rigid.

In another aspect, a contact lens package is provided. The contact lens package may include a cavity that houses a contact lens and packaging solution, with a vacuum being maintained within the cavity when the package is in an unopened state.

In some embodiments, an absolute pressure within the cavity may be less than about 91 kPa when the package is in the unopened state. In some embodiments, an absolute pressure within the cavity may be within a range of about 11 kPa to about 91 kPa when the package is in the unopened state. In some embodiments, the package also may include a base and a lid connected to the base, and the cavity may be formed between the base and the lid. In some embodiments, the base and the lid may collectively surround the cavity. In some embodiments, the base and the lid may collectively define the cavity. In some embodiments, the base may be flexible, and the lid may be flexible. In some embodiments, the base may include a foil layer, and the lid may include a foil layer. In some embodiments, the base may be substantially rigid, and the lid may be flexible. In some embodiments, the lid may extend over and cover the contact lens when the package is in the unopened state, the lid may not cover the contact lens when the package is in an opened state, and the contact lens may be disposed within the cavity such that a convex surface of the contact lens faces the lid when the package is in the unopened state. In some embodiments, the package also may include a lens support disposed within the cavity, and the lens support may include a support surface that supports the contact lens within the cavity. In some embodiments, the lens support may be disposed between the base and the lid. In some embodiments, the lens support may be connected to the base. In some embodiments, the support surface may engage a concave surface of the contact lens. In some embodiments, the support surface may be a convex surface. In some embodiments, the lens support may include a bowl including a bowl cavity that houses the contact lens and the packaging solution. In some embodiments, the lid may extend over and cover the lens support when the package is in the unopened state, and the lid may not cover the lens support when the package is in an opened state. In some embodiments, the base may be flexible, the lid may be flexible, and the lens support may be substantially rigid.

In still another aspect, a method of packaging a contact lens is provided. The method may include disposing a contact lens and packaging solution within a cavity of the package, creating a vacuum within the cavity such that an absolute pressure within the cavity is less than standard atmospheric pressure, and enclosing the cavity such that the vacuum is maintained within the cavity when the package is in an unopened state.

In some embodiments, the absolute pressure within the cavity may be within a range of about 11 kPa to about 91 kPa when the package is in the unopened state. In some embodiments, the package may include a base and a lid connected to the base, the cavity may be formed between the base and the lid, and enclosing the cavity may include connecting the lid to the base. In some embodiments, the contact lens may be disposed within the cavity such that a convex surface of the contact lens faces the lid. In some embodiments, the method also may include disposing a lens support within the cavity, and the lens support may include a support surface that supports the contact lens within the cavity.

In yet another aspect, a method of opening a contact lens package is provided. The method may include holding the package, with the package including a cavity that houses a contact lens and packaging solution, and with a vacuum being maintained within the cavity such that an absolute pressure within the cavity is less than standard atmospheric. The method also may include transitioning the package from an unopened state to an opened state such that the vacuum is no longer maintained within the cavity, engaging the contact lens, and removing the contact lens from the package via the engagement.

In some embodiments, the absolute pressure within the cavity may be within a range of about 11 kPa to about 91 kPa when the package is in the unopened state. In some embodiments, the package may include a base and a lid connected to the base, the cavity may be formed between the base and the lid, and transitioning the package from the unopened state to the opened state may include at least partially removing the lid from the base. In some embodiments, engaging the contact lens may include engaging a convex surface of the contact lens. In some embodiments, the package may include a lens support disposed within the cavity, the lens support may include a support surface that supports the contact lens within the cavity, and removing the contact lens from the package may include removing the contact lens from the lens support.

These and other aspects and improvements of the present disclosure will become apparent to one of ordinary skill in the art upon review of the following detailed description when taken in conjunction with the accompanying drawings and the appended claims.

III. BRIEF DESCRIPTION OF THE DRAWINGS

The foregoing and other features and advantages of the invention will be apparent from the following, more particular description of certain embodiments of the present disclosure, as illustrated in the accompanying drawings.

Figure 1A:
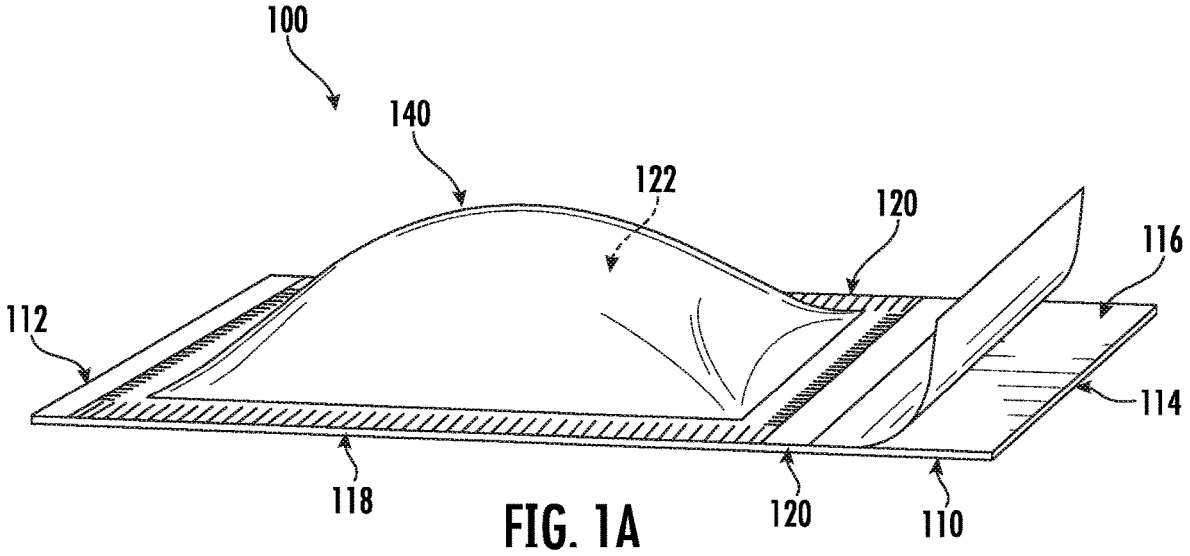
FIG. 1A is a side perspective view of an example contact lens package in accordance with embodiments of the disclosure, showing the contact lens package in an unopened state.
Figure 2A:
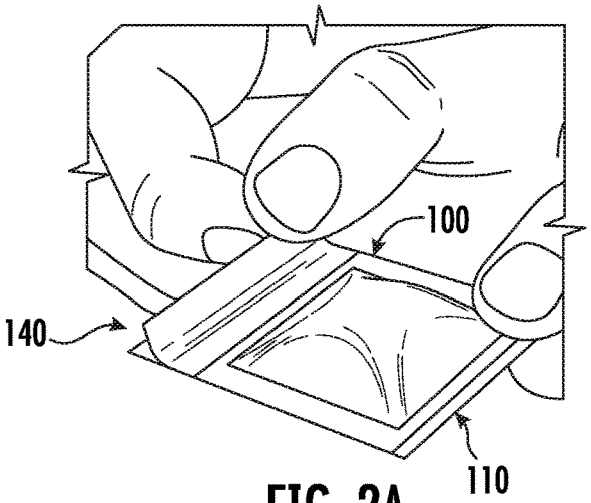
Figure 2B:
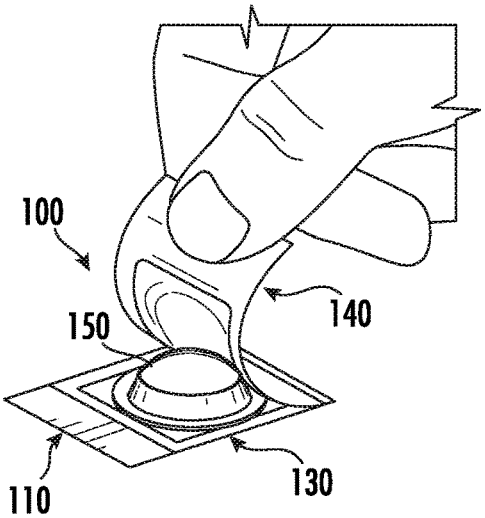
Figure 2C:
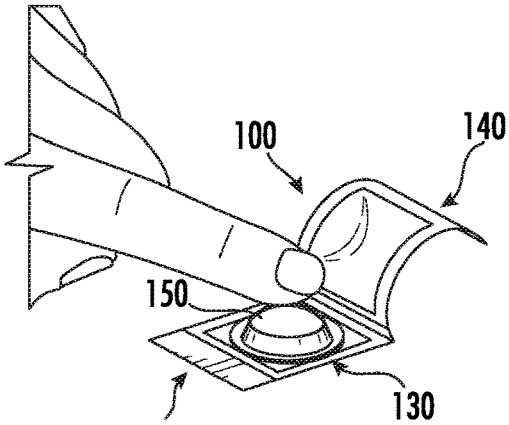

FIGS. 2A-2C are perspective views illustrating an example method of opening the contact lens package of FIG. 1A in accordance with embodiments of the disclosure. FIG. 2A shows a user holding the contact lens package and grasping a lid of the contact lens package. FIG. 2B shows the user at least partially removing the lid from a base of the contact lens package to expose a contact lens supported by a lens support of the contact lens package. FIG. 2C shows the user engaging the contact lens for removal from the lens support.

Figure 3A:
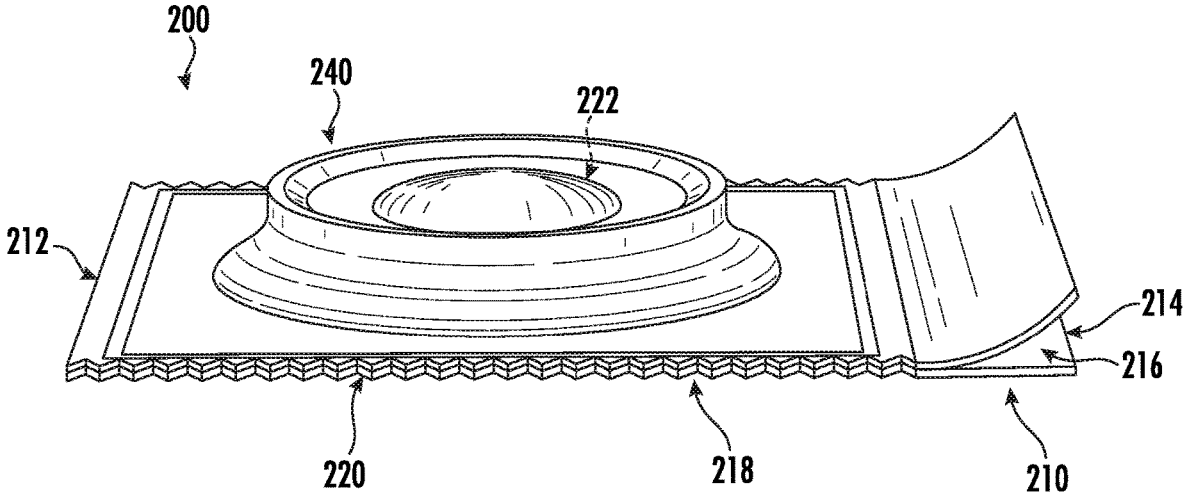

FIG. 3A is a side perspective view of an example contact lens package in accordance with embodiments of the disclosure, showing the contact lens package in an unopened state.

Figure 3B:
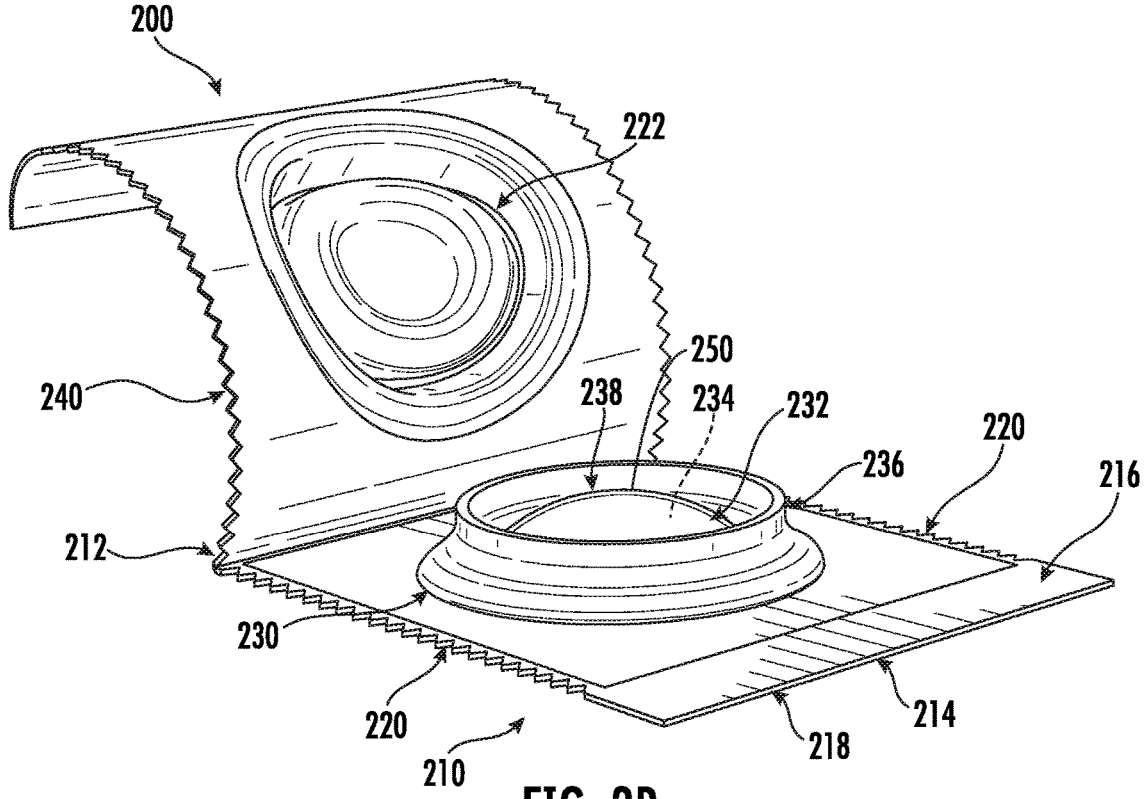

FIG. 3B is a top perspective view of the contact lens package of FIG. 3A in an opened state.

IV. DETAILED DESCRIPTION

Reference will now be made in detail to representative embodiments illustrated in the accompanying drawings wherein reference numerals indicate certain elements. The following descriptions are not intended to limit the myriad embodiments to one preferred embodiment. To the contrary, it is intended to cover alternatives, modifications, and equivalents as can be included within the spirit and scope of the described embodiments as defined by the appended claims.

References to "one embodiment," "an embodiment," "some embodiments," "an example embodiment," etc., indicate that the embodiment described may include a particular feature, structure, aspect, or characteristic, but every embodiment may not necessarily include the particular feature, structure, or characteristic. Moreover, such phrases are not necessarily referring to the same embodiment. Further, when a particular feature, structure, aspect, or characteristic is described in connection with an embodiment, it is submitted that it is within the knowledge of one skilled in the art to effect such feature, structure, or characteristic in connection with other embodiments whether or not explicitly described.

Lens(es) or contact lens(es) refer to ophthalmic devices that reside on the eye. They have a generally hemispheric shape and can provide optical correction, cosmetic enhancement, UV blocking and visible light or glare reduction, therapeutic effect, including wound healing, delivery of drugs or neutraceuticals, diagnostic evaluation or monitoring, or any combination thereof. The term lens includes soft hydrogel contact lenses, which are generally provided to the consumer in a package in the hydrated state, and have a relatively low moduli, which allows them to conform to the cornea. Contact lenses suitable for use with the packages of the present invention include all hydrated contact lenses, including conventional and silicone hydrogel contact lenses.

A hydrogel is a hydrated crosslinked polymeric system that contains water in an equilibrium state, and may contain at least about 25%, or at least 35% water in the hydrated state. Hydrogels typically are oxygen permeable and biocompatible, making them excellent materials for producing contact lenses.

Conventional hydrogel contact lenses do not contain silicone containing components, and generally have higher water content, lower oxygen permeability, moduli, and shape memories than silicone hydrogels. Conventional hydrogels are prepared from monomeric mixtures predominantly containing hydrophilic monomers, such as 2-hydroxyethyl methacrylate ("HEMA"), N-vinyl pyrrolidone ("NVP") or polyvinyl alcohols. U.S. Pat. Nos. 4,495,313, 4,889,664 and 5,039,459 disclose the formation of conventional hydrogels. Conventional hydrogels may be ionic or non-ionic and include polymacon, etafilcon, nelfilcon, ocufilcon lenefilcon and the like. The oxygen permeability of these conventional hydrogel materials is typically below 20-30 barrers.

Silicon hydrogel formulations include balafilcon samfilcon, lotrafilcon A and B, delfilcon, galyfilcon, senofilcon A, B and C, narafilcon, comfilcon, formofilcon, riofilcon, fanfilcon, stenfilcon, somofilcon, kalifilcon and the like. "Silicone hydrogels" refer to polymeric networks made from at least one hydrophilic component and at least one silicone-containing component. Silicone hydrogels may have moduli in the range of 60-200, 60-150 or 80-130 psi, water contents in the range of 20 to 60%. Examples of silicone hydrogels include acquafilcon, asmofilcon, balafilcon, comfilcon, delefilcon, enfilcon, fanfilcon, formofilcon, galyfilcon, lotrafilcon, narafilcon, riofilcon, samfilcon, senofilcon, somofilcon, and stenfilcon, verofilcon, including all of their variants, as well as silicone hydrogels as prepared in U.S. Pat. Nos. 4,659,782, 4,659,783, 5,244,981, 5,314,960, 5,331,067, 5,371,147, 5,998,498, 6,087,415, 5,760,100, 5,776,999, 5,789,461, 5,849,811, 5,965,631, 6,367,929, 6,822,016, 6,867,245, 6,943,203, 7,247,692, 7,249,848, 7,553,880, 7,666,921, 7,786,185, 7,956,131, 8,022,158, 8,273,802, 8,399,538, 8,470,906, 8,450,387, 8,487,058, 8,507,577, 8,637,621, 8,703,891, 8,937,110, 8,937,111, 8,940,812, 9,056,878, 9,057,821, 9,125,808, 9,140,825, 9,156,934, 9,170,349, 9,244,196, 9,244,197, 9,260,544, 9,297,928, 9,297,929 as well as WO 03/22321, WO 2008/061992, and US 2010/0048847. These patents are hereby incorporated by reference in their entireties. Silicone hydrogels may have higher shape memory than conventional contact lenses.

Hydrogel lenses are viscoelastic materials. Contact lenses can form optical distortions if the lens interacts with either the package or any air bubble in the package. The extent of the optical distortions, and the length of time needed for the distortions to relax out will vary depending on the chemistry, and to a lesser extent, geometry of the lens. Conventional lens materials, such as polyhydroxyethyl methacrylate-based lenses like etafilcon A or polymacon have low loss modulus and tan delta compared to silicone hydrogels and may form fewer and less severe optical distortions as a result of contact with packaging. The incorporation of silicones (which generally increase the bulk elastic response), wetting agents such as PVP (which generally increase the viscous response) or coatings of conventional hydrogel materials (which may lower the elastic response at the lens interface) can alter the lens viscoelastic properties. Conventional hydrogel contact lenses and silicone hydrogel contact lenses having short or stiff crosslinking agents and or stiffening agent have short shape memories and may be less susceptible to deformation during storage. As used herein, high or higher shape memory hydrogels display optical distortions from contact with an air bubble or package of at least about 0.18 after 5 weeks of accelerated aging at 55° C. Viscoelastic properties, including loss modulus and tan delta, can be measured using a dynamic mechanical analysis.

The contact lenses can be of any geometry or power, and have a generally hemispherical shape, with a concave posterior side which rests against the eye when in use and a convex anterior side which faces away from the eye and is contacted by the eyelid during blinking.

The center or apex of the lens is the center of the lens optic zone. The optic zone provides optical correction and may have a diameter between about 7 mm and about 10 mm. The lens periphery or lens edge is the edge where the anterior and posterior sides meet.

Embodiments may include a lens support surrounded by a sealable cavity also interchangeably referred to as a chamber. The cavity may have any convenient form and may comprise a package base and at least a lid, each of which are described in detail below. As used herein, the phrases "the lid", "a lid", "the base" and "a base" encompass both the singular and plural. The lid and package base are sealed to each other to form a cavity which holds the contact lens, support and packaging solution in a sterile state during shipping and storage prior to use. The contact lens package is made from materials which are compatible with the contact lens and solution, as well as retortable and biologically inert.

"Film" or "multilayer film" are films used to seal the package and are often referred to as lidstock. Multilayer films used in conventional contact lens packages may be used in the packages of the present invention as the base, a component of the lid, or both. Multilayer films comprise a plurality of layers, including barrier layers, including foil layers, or coatings, seal layers, which seal the film to the rest of the package, and may also comprise additional layers selected from peel initiation layers, lamination layers, and layers that improve other package properties like stiffness, temperature resistance, printability, puncture resistance, barrier resistance to water or oxygen and the like. The multilayer films form a steam sterilizable (retortable) seal. The multilayer film can include PET, BON or OPP films layers to increase stiffness and temperature resistance, or to EVOH or PVDC coatings to improve barrier resistance to oxygen or moisture vapor.

An "unopened state" or "unopened" as used herein refers to a contact lens package that is closed and houses a contact lens in solution.

An "opened state" or "opened" as used herein refers to a contact lens package after the sterile seal has been broken. Depending on the context described herein, the opened state extends to the state of the package when the user has manipulated the package to cause the lens accessible to the user for transfer to the eye.

A "wearer" or "user" as used herein refers to a person opening a contact lens package. The user is generally referred to as the person who both opens the package and transfers the contact lens contained therein to their eye. However, the user in some contexts may be a person handling the lens package on behalf of the wearer, such an eye care provider ("ECP") or another individual demonstrating for or assisting the wearer.

Packaging solution is any physiologically compatible solution, which is compatible with the selected lens material and packaging. Packaging solutions include buffered solutions having a physiological pH, such as buffered saline solutions. The packaging solution may contain known components, including buffers, pH and tonicity adjusting agents, lubricants, wetting agents, nutraceuticals, pharmaceuticals, in package coating components and the like.

The package base may form the bottom of the package. It can be made from any material suitable for packaging medical devices, including plastic. The packaging lid generally resides at the upper portion the package and seals with the base to form a cavity containing at least a portion of the lens support, lens, and packaging solution. The lid may be made from any material suitable for packaging medical devices, including a molded sheet of foil or plastic, laminate films, or plastic. Packages comprising plastic for one structure and foil or laminated films as the other, or packages comprising foil or laminated films as the outer layer for the lid and base are known in the art and are examples of suitable combinations.

References throughout this description to injection molding processes and the use of materials conventionally applied to injection molding should be understood as exemplary. Those of skill in the art will appreciate that other means of manufacture are possible within the scope of the appended claims, including but not limited to alternative molding processes, thermoforming, 3D printing, and the like. Likewise, references to heat seals and heat sealing are exemplary to embodiments described herein. Other means of securing packaging components will be apparent to those skilled in the art, including the use of adhesive, glue, thermal bonding, welding such as heat, ultrasonic or laser welding, or a mechanical trap, and the like.

Certain aspects of the invention may serve to reduce or prevent significant optical damage to the contact lens due to interactions with air bubbles or the interior of the lens package that may arise during storage or transit due to gravitational or other forces, such as mechanical pressure being applied from outside of the package. As used herein, significant optical damage means a root-mean-squared (RMS) value equal or greater than about 0.08 μm.

Figure 1B:
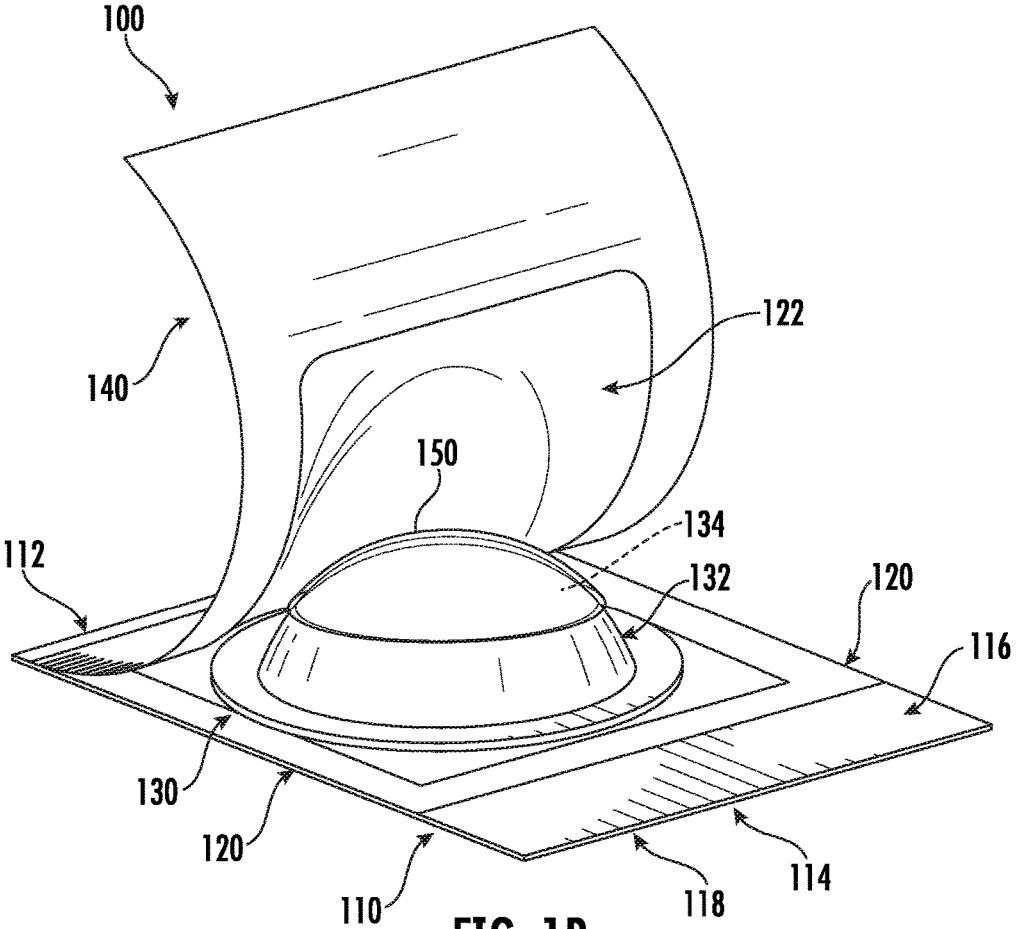
FIG. 1B is a top perspective view of the contact lens package of FIG. 1A in an opened state.
Figure 1C:
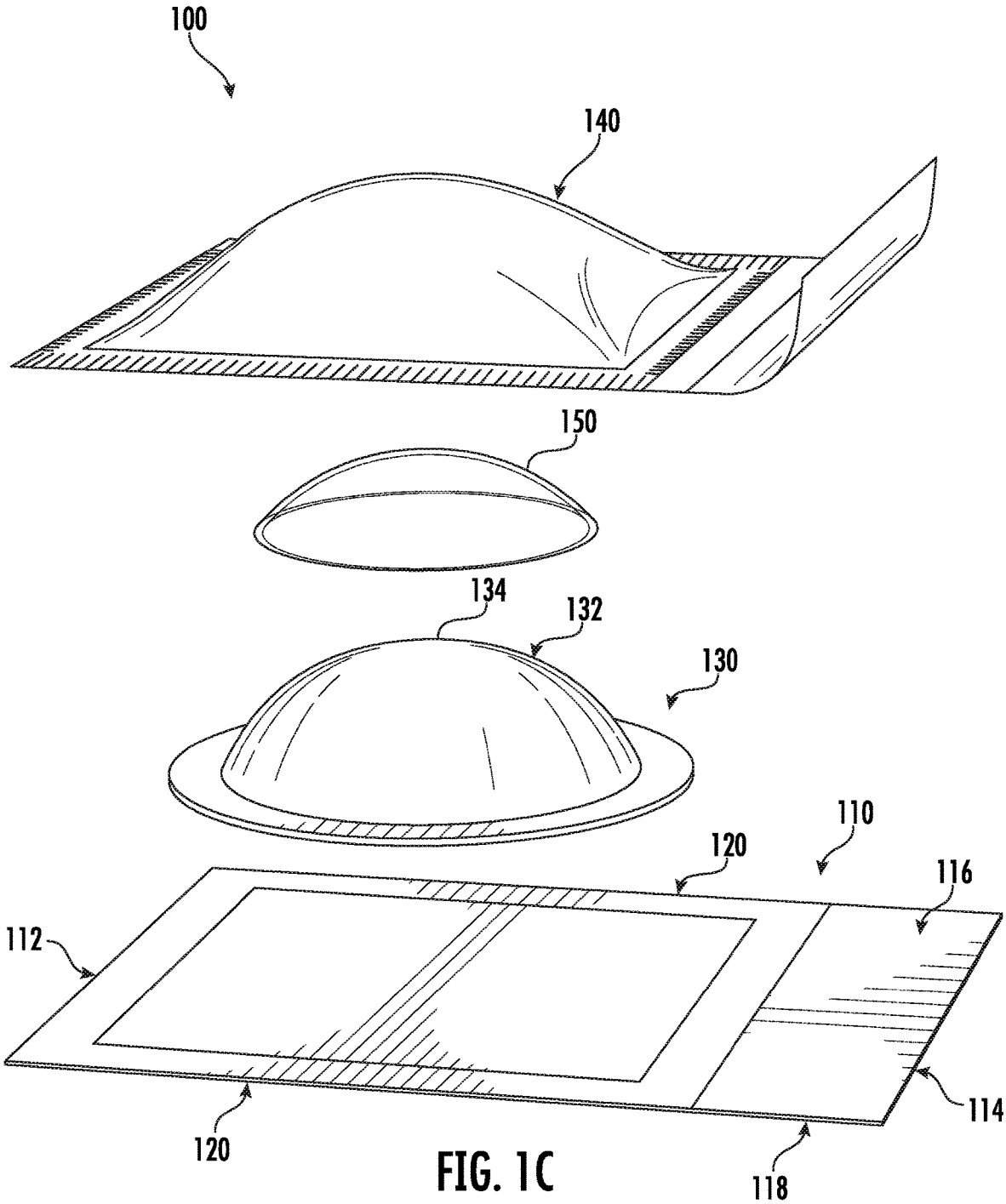
FIG. 1C is an exploded side perspective view of a base, a lid, a lens support, and a contact lens of the contact lens package of FIG. 1A.

Referring now to the drawings, FIGS. 1A-1C illustrate an example pressurized contact lens package 100 in accordance with embodiments of the present disclosure. As described, the contact lens package 100 may include a base 110, a lens support 130, a lid 140, a contact lens 150, and packaging solution (not illustrated). The contact lens package 100 may have an unopened state, as shown in FIG. 1A, and an opened state, as shown in FIG. 1B. When the contact lens package 100 is in the unopened state, the contact lens 150 and the packaging solution may be housed within a cavity 122 formed between the base 110 and the lid 140. As described below, a positive pressure environment may be maintained within the cavity 122 when the contact lens package 100 is in the unopened state, which may allow the amount of material of the base 110 and/or the lid 140 to be minimized as well as the use of flexible materials for the base 110 and/or the lid 140 while still providing sufficient protection for the contact lens 150. In this manner, the contact lens 150 may be protected between the base 110 and the lid 140 and exposed to the packaging solution until the contact lens package 100 is opened for removal of the contact lens 150. When desired, a user may open the contact lens package 100 by at least partially removing the lid 140 from the base 110 to allow access to the contact lens 150. Such removal of the lid 140 may allow the user to engage and remove the contact lens 150 from the cavity 122. As shown, the lens support 130 may be disposed within the cavity 122 to maintain a position and orientation of the contact lens 150 within the cavity 122. As shown in FIGS. 1B and 1C, the contact lens 150 may be housed within the cavity 122 and supported by the lens support 130 such that a convex surface of the contact lens 150 faces the lid 140 when the contact lens package 100 is in the unopened state. In this manner, when the contact lens package 100 is opened, the user may engage the convex surface for removal of the contact lens 150 and subsequent placement of the contact lens 150 on the user's eye.

According to the illustrated example, the base 110 may have a first end 112 (which also may be referred to as a "back end" in certain embodiments) and a second end 114 (which also may be referred to as a "front end" in certain embodiments) disposed opposite one another. As shown, the base 110 may have a first side 116 (which also may be referred to as a "top side" in certain embodiments) and a second side 118 (which also may be referred to as a "bottom side" in certain embodiments) disposed opposite one another and each extending from the first end 112 to the second end 114. The base 110 also may have a pair of lateral sides 120 disposed opposite one another and each extending from the first end 112 to the second end 114. In some embodiments, as shown, the base 110 may be formed as a planar member. In other embodiments, the base 110 may have a contoured shape. For example, in such embodiments, the base 110 may define a base cavity that forms a portion of the overall cavity 122 of the contact lens package 100. As discussed above, the base 110 may be formed of any suitable material. In certain embodiments, the base 110 may be substantially rigid. As used herein, "substantially rigid" means that the material does not deform under typical storage and use conditions for contact lens packages. In other embodiments, the base 110 may be flexible, such as a foil. As used herein, a "flexible" material is one that is not substantially rigid.

The lens support 130 may be disposed within the cavity 122 and may support the contact lens 150 in a desired position and orientation within the cavity 122. As shown, the lens support 130 may be disposed between the base 110 and the contact lens 150. In some embodiments, the lens support 130 may be connected to the base 110, for example, by an adhesive or other means of attachment. As shown, the lens support 130 may include a support surface 134 that engages and supports the contact lens 150 within the cavity 122. In particular, the support surface 134 may engage the concave surface of the contact lens 150. In some embodiments, the support surface 134 may be a convex surface, although other shapes of the support surface 134 may be used in other embodiments. As shown, the lens support 130 may include a dome 132 extending upward from the base 110, and the support surface 134 may be a convex outer surface of the dome 132. The lens support 130 may be formed of any suitable material. In some embodiments, the lens support 130 may be substantially rigid. In embodiments utilizing a substantially rigid material, such material preferably has a glass transition temperature ($T_g$) of about 125 C as measured in accordance with ASTM D1238-10 (Standard Test method for Melt Flow Rates of Thermoplastics by Extrusion Plastometer).

As shown, the lid 140 may be connected to the base 110 and may extend over at least part of the base 110 and seal the contact lens 150 and the packaging solution within the cavity 122 when the contact lens package 100 is in the unopened state. In this manner, the base 110 and the lid 140 together may form the sealed cavity 122 for containing the contact lens 150 and the packaging solution until a user desires to open the contact lens package 100 and remove the contact lens 150 for use. In some embodiments, as shown, when the contact lens package 100 is in the unopened state, the lid 140 may extend over and cover the lens support 130 and respective portions of the base 110. When the contact lens package 100 is in the unopened state, respective portions of the lid 140 may be sealed to respective adjacent portions of the base 110, such as portions of the base 110 surrounding the lens support 130, such that the lens support 130, the contact lens 150, and the packaging solution are contained within the cavity 122 formed by the base 110 and the lid 140. The seal between the lid 140 and the base 110 may be at least partially broken when the contact lens package 100 is transitioned from the unopened state to an opened state for removal of the contact lens 150. As discussed above, the lid 140 may be formed of any suitable material. In certain embodiments, as shown, the lid 140 may be flexible.

As discussed above, a positive pressure environment may be maintained within the cavity 122 when the contact lens package 100 is in the unopened state. In other words, the cavity 122 may be pressurized such that an absolute pressure within the cavity 122 is greater than local atmospheric pressure when the contact lens package 100 is in the unopened state. In some embodiments, the absolute pressure within the cavity 122 may be greater than standard atmospheric pressure (101.325 kPa) when the contact lens package 100 is in the unopened state. In some embodiments, the absolute pressure within the cavity 122 may be greater than about 171 kPa when the contact lens package 100 is in the unopened state. In some embodiments, the absolute pressure within the cavity 122 may be within a range of about 171 kPa to about 601 kPa when the contact lens package 100 is in the unopened state. The lower end of the range, i.e., about 171 kPA represents a pressure large enough to counteract crushing forces that may be applied to the package and otherwise damage the lens. At this 171 kPa approximate pressure point, the pack may support 10-15 N of force without compromising the lens experiencing significant optical damage. The upper end of this range, i.e., about 601 kPA represents the material and weld strength generally achievable using the contact lens packaging materials generally described herein. Due to the positive pressure environment, the pressure within the cavity 122 may resist external forces applied to the respective portions of the base 110 and the lid 140 forming the cavity 122, thereby protecting the contact lens 150 within the cavity 122 from such external forces. In this manner, one or both of the base 110 and the lid 140 may be formed as a relatively thin layer of flexible material, such as a foil layer, while still providing sufficient protection for the contact lens 150. In some embodiments, the base 110 may be substantially rigid, and the lid 140 may be flexible. In some embodiments, the base 110 may be flexible, and the lid 140 may be flexible.

It should be noted that pressurized contact lens packages within the scope of the invention may be achieved with or without the use of a lens support. Providing a lens support, such as lens support 130 depicted in the embodiment disclosed, may aid in retaining the shape and optical integrity of certain lens materials, such as silicone hydrogel materials, when packaged under pressure. In alternative embodiments, however, such as packages designed to accommodate lenses composed of more resilient materials, the lens may retain its shape under pressure and thus render a lens support unnecessary, if desired. Furthermore, where a lens support is provided, the lens support may take on any of myriad designs beyond the conventional dome shape of the exemplary embodiment disclosed herein. For example, other in some embodiments a lens support may be provided with features that may facilitate single-touch transfer by, inter alia, providing means for channeling packaging solution away from the lens and/or by incorporating a shape that minimizes the wetted contact area between the lens support and the contact lens. Several merely illustrative examples of such lens support designs are provided herein at Appendix A.

FIGS. 2A-2C illustrate an example method of opening the contact lens package 100 in accordance with embodiments of the present disclosure. As noted above, the contact lens package 100 may be provided and stored in the unopened state, as shown in FIG. 1A, until a user desires to open the package 100. With the contact lens package 100 in the unopened state, the user may hold the base 110 and grasp an end region of the lid 140, as shown in FIG. 2A. The user may at least partially remove the lid 140 from the base 110 by pulling the end region of the lid 140 away from the base 110, as shown in FIG. 2B. In this manner, at least a portion of the seal between the lid 140 and the base 110 may be broken. As shown, the lid 140 may be removed from the base 110 such that the contact lens 150 and the lens support 130 are no longer covered by the lid 140. In some embodiments, the lid 140 may be entirely removed from the base 110. After at least partially removing the lid 140 from the base 110, the user may engage the contact lens 150 while the contact lens 150 is supported by the lens support 130, as shown in FIG. 2C. According to the illustrated embodiment in which the lens support 130 supports the concave surface of the contact lens 150, the user may engage the convex surface of the contact lens 150 and remove the contact lens 150 from the lens support 130. In this manner, with a single touch, the contact lens 150 may be conveniently removed from the lens support 130 and held on the user's finger in the desired concave-side-up orientation, ready for positioning on the user's eye.

One exemplary process for manufacturing a pressurized contact lens package in accordance with embodiments of the present invention is now described. First, a base and a lid may be provided. Next, optionally, a lens support may be provided and attached to the base by any number of means, including the use of biocompatible adhesive, thermal bonding, welding such as heat, ultrasonic or laser welding, or a mechanical trap, and the like. At a next step, a contact lens may be placed onto the lens support. In a slight alternative ordering, the contact lens may be placed onto the lens support before the lens support is placed onto the base. Where no lens support is desired or required, the contact lens may be placed directly onto the base material. It may be beneficial to dose the lens material, lens support, and/or base material with a fractional dose of packaging solution sufficient to cause the contact lens to bind to the lens support or base material. At a next step, a partial seal may be created between the base and the lid material, such as through a conventional heat-sealing process. The partial seal may circumscribe the lens support or contact lens to create a cavity between the base and lid that is fully sealed with the exception of a small opening sufficient only to create a channel that allows the injection of packing solution via a nozzle. It is preferable that the nozzle be placed into the channel prior to the creation of the partial seal so that when packaging solution is injected through the nozzle fluid does not escape around the cavity along the sides of the nozzle.

Packaging solution may then be pumped into the cavity via the nozzle until a prescribed pressure, e.g., about 171 kPa to about 601 kPa, is obtained within the package. With this pressure obtained, the channel may then be fully sealed, e.g., by a second heat sealing step, such that the small opening where the nozzle was inserted becomes sealed. This may be accomplished in one aspect by backing the nozzle out of the package cavity but not entirely beyond the edge of the base/lid material, i.e., to the point where a full seal can be created without allowing the packaging solution or escape or the nozzle interfering with the heat seal.

FIGS. 3A-3B illustrate an example vacuum-sealed contact lens package 200 in accordance with embodiments of the present disclosure. As described, the contact lens package 200 may include a base 210, a lens support 230, a lid 240, a contact lens 250, and packaging solution. The contact lens package 200 may have an unopened state, as shown in FIG. 3A, and an opened state, as shown in FIG. 3B. When the contact lens package 200 is in the unopened state, the contact lens 250 and the packaging solution may be housed within a cavity 222 formed between the base 210 and the lid 240. As described below, a vacuum (i.e., a negative pressure environment) may be maintained within the cavity 222 when the contact lens package 200 is in the unopened state, which may allow the amount of the packaging solution to be minimized while still maintaining sufficient hydration of the contact lens 250. Further, the vacuum within the cavity 222 may allow the amount of material of the base 210 and/or the lid 240 to be minimized as well as the use of flexible materials for the base 210 and/or the lid 240 while still providing sufficient protection from air bubbles for the contact lens 250. The contact lens 250 may be protected between the base 210 and the lid 240 and exposed to the packaging solution until the contact lens package 200 is opened for removal of the contact lens 250. When desired, a user may open the contact lens package 200 by at least partially removing the lid 240 from the base 210 to allow access to the contact lens 250. Such removal of the lid 240 may allow the user to engage and remove the contact lens 250 from the cavity 222. As shown, the lens support 230 may be disposed within the cavity 222 to maintain a position and orientation of the contact lens 250 within the cavity 222. As shown in FIG. 3B, the contact lens 250 may be housed within the cavity 222 and supported by the lens support 230 such that a convex surface of the contact lens 250 faces the lid 240 when the contact lens package 200 is in the unopened state. In this manner, when the contact lens package 200 is opened, the user may engage the convex surface for removal of the contact lens 250 and subsequent placement of the contact lens 250 on the user's eye, enabling a single-touch user experience and avoiding the drawbacks of certain existing contact lens packages as discussed above.

According to the illustrated example, the base 210 may have a first end 212 (which also may be referred to as a "back end" in certain embodiments) and a second end 214 (which also may be referred to as a "front end" in certain embodiments) disposed opposite one another. As shown, the base 210 may have a first side 216 (which also may be referred to as a "top side" in certain embodiments) and a second side 218 (which also may be referred to as a "bottom side" in certain embodiments) disposed opposite one another and each extending from the first end 212 to the second end 214. The base 210 also may have a pair of lateral sides 220 disposed opposite one another and each extending from the first end 212 to the second end 214. In some embodiments, as shown, the base 210 may be formed as a planar member. In other embodiments, the base 210 may have a contoured shape. For example, in such embodiments, the base 210 may define a base cavity that forms a portion of the overall cavity 222 of the contact lens package 200. As discussed above, the base 210 may be formed of any suitable material. In certain embodiments, the base 210 may be substantially rigid. In other embodiments, the base 210 may be flexible.

The lens support 230 may be disposed within the cavity 222 and may support the contact lens 250 in a desired position and orientation within the cavity 222. As shown, the lens support 230 may be disposed between the base 210 and the contact lens 250. In some embodiments, the lens support 230 may be connected to the base 210, for example, by an adhesive or other means of attachment. As shown, the lens support 230 may include a support surface 234 that engages and supports the contact lens 250 within the cavity 222. In particular, the support surface 234 may engage the concave surface of the contact lens 250. In some embodiments, the support surface 234 may be a convex surface, although other shapes of the support surface 234 may be used in other embodiments. As shown, the lens support 230 may include a dome 232 extending upward from the base 210, and the support surface 234 may be a convex outer surface of the dome 232. In some embodiments, the lens support 230 also may include a bowl 236 having a bowl cavity 238 that houses the contact lens 250 and the packaging solution. As shown, the bowl 236 may extend upward from the base 210 and beyond the contact lens 250 disposed within the bowl cavity 238. In this manner, the bowl 236 may surround and protect the contact lens 250. The lens support 230 may be formed of any suitable material. In some embodiments, the lens support 230 may be substantially rigid.

It should be noted that vacuum-sealed contact lens packages within the scope of the invention may be achieved with or without the use of a lens support. Providing a lens support, such as lens support 230 depicted in the embodiment disclosed, may aid in retaining the shape and optical integrity of certain lens materials, such as silicone hydrogel materials, when packaged under pressure. In alternative embodiments, however, such as packages designed to accommodate lenses composed of more resilient materials, the lens may retain its shape under negative pressure and thus render a lens support unnecessary, if desired. Furthermore, where a lens support is provided, the lens support may take on any of myriad designs beyond the conventional dome shape of the exemplary embodiment disclosed herein.

As shown, the lid 240 may be connected to the base 210 and may extend over at least part of the base 210 and seal the contact lens 250 and the packaging solution within the cavity 222 when the contact lens package 200 is in the unopened state. In this manner, the base 210 and the lid 240 together may form the sealed cavity 222 for containing the contact lens 250 and the packaging solution until a user desires to open the contact lens package 200 and remove the contact lens 250 for use. In some embodiments, as shown, when the contact lens package 200 is in the unopened state, the lid 240 may extend over and cover the lens support 230 and respective portions of the base 210. When the contact lens package 200 is in the unopened state, respective portions of the lid 240 may be sealed to respective adjacent portions of the base 210, such as portions of the base 210 surrounding the lens support 230, such that the lens support 230, the contact lens 250, and the packaging solution are contained within the cavity 222 formed by the base 210 and the lid 240. The seal between the lid 240 and the base 210 may be at least partially broken when the contact lens package 200 is transitioned from the unopened state to an opened state for removal of the contact lens 250. As discussed above, the lid 240 may be formed of any suitable material. In certain embodiments, as shown, the lid 240 may be flexible.

As discussed above, a vacuum may be maintained within the cavity 222 when the contact lens package 200 is in the unopened state. In other words, the cavity 222 may be pressurized such that an absolute pressure within the cavity 222 is less than local atmospheric pressure when the contact lens package 200 is in the unopened state. In some embodiments, the absolute pressure within the cavity 222 may be less than standard atmospheric pressure (101.325 kPa) when the contact lens package 200 is in the unopened state. In some embodiments, the absolute pressure within the cavity 222 may be less than about 91 kPa when the contact lens package 200 is in the unopened state. In some embodiments, the absolute pressure within the cavity 222 may be within a range of about 11 kPa to about 91 kPa when the contact lens package 200 is in the unopened state. Due to the vacuum, the size of a headspace air bubble within the cavity 222 may be minimized, thereby allowing the amount of the packaging solution to be minimized while still maintaining sufficient hydration of the contact lens 250. In general, a headspace air bubble is a consequence of a sealing process for contact lens packaging. For example, when heat sealing foils, it is generally necessary to keep the seal region dry. Doing so requires a certain volume of air inside the package so that the water level in the pack stays below the welding level. If the packaging solution is dispensed into the package in a low-pressure environment, then the air is less dense, the required volume of air has a lower mass. After dispensing the packaging solution, the pressure returns to normal, and the headspace air bubble shrinks. A smaller headspace air bubble enables design a smaller pack, and thus a more ecologically sustainable package, because less space is needed to keep the air bubble away from the lens. Accordingly, in order to minimize the headspace air bubble, one or both of the base 210 and the lid 240 may be formed as a relatively thin layer of flexible material, such as a foil layer, and thus may conform to the shape of adjacent portions of the lens support 230 and the contact lens 250 when the vacuum is created within the cavity 222. In some embodiments, the base 210 may be substantially rigid, and the lid 240 may be flexible. In some embodiments, the base 210 may be flexible, and the lid 240 may be flexible.

The contact lens package 200 may be opened in a manner similar to that described above for the contact lens package 100 with respect to FIGS. 2A-2C. As noted above, the contact lens package 200 may be provided and stored in the unopened state, as shown in FIG. 3A, until a user desires to open the package 200. With the contact lens package 200 in the unopened state, the user may hold the base 210 and grasp an end region of the lid 240. The user may at least partially remove the lid 240 from the base 210 by pulling the end region of the lid 240 away from the base 210. In this manner, at least a portion of the seal between the lid 240 and the base 210 may be broken. The lid 240 may be removed from the base 210 such that the contact lens 250 and the lens support 230 are no longer covered by the lid 240. In some embodiments, the lid 240 may be entirely removed from the base 210. After at least partially removing the lid 240 from the base 210, the user may engage the contact lens 250 while the contact lens 250 is supported by the lens support 230. According to the illustrated embodiment in which the lens support 230 supports the concave surface of the contact lens 250, the user may engage the convex surface of the contact lens 250 and remove the contact lens 250 from the lens support 230. In this manner, the contact lens 250 may be conveniently removed from the lens support 230 and held on the user's finger in the desired concave-side-up orientation, ready for positioning on the user's eye.

An exemplary process for manufacturing a vacuum-sealed contact lens package in accordance with embodiments of the present invention is now described. First, a base and a lid may be provided. In on embodiment, the base and lid are a single rectangular sheet of multilayer film that have been creased along a first end. Alternatively, the base and lid may be two sheets of similarly sized, rectangular multilayer film that have been heat sealed along a first end. Next, optionally, a lens support may be attached to the base by any number of means, including the use of biocompatible adhesive, thermal bonding, welding such as heat, ultrasonic or laser welding, or a mechanical trap, and the like. At a next step, a contact lens may be placed onto the lens support. In a slight alternative ordering, the contact lens may be placed onto the lens support before the lens support is placed onto the base. Where no lens support is desired or required, the contact lens may be placed directly onto the base material. It may be beneficial to dose the lens material, lens support, and/or base material with a fractional dose of packaging solution sufficient to cause the contact lens to bind to the lens support or base material.

Next, the base and lid may be sealed along its left and right sides to create a cavity containing the lens and optional lens support, where the package remains open at its second end. A nozzle may be inserted into the open end and a chamber sealing device may be over the end of the open, second end of the package over the edge of the base, lid and nozzle therebetween. The chamber sealer may then be activated until it evacuates air from the cavity until the prescribed negative pressure within the cavity is achieved, e.g., less than about 91 kPA and preferably between about 11 and 91 kPA. Once a negative pressure within the desired range has been achieved, packaging solution supplied through the nozzle into the cavity in a volume sufficient to maintain the lens in hydration but less than a volume that would drive the pressure within the cavity above the desired range. Finally, the nozzle may be withdrawn, a heat seal created along the second end, and the chamber sealer released.

The foregoing description, for purposes of explanation, used specific nomenclature to provide a thorough understanding of the described embodiments. However, it will be apparent to one skilled in the art that many of the specific details are not required in order to practice the described embodiments. Thus, the foregoing descriptions of the specific embodiments described herein are presented for the purposes of illustration and description. They are not targeted to be exhaustive or to limit the embodiments to the precise forms disclosed. It will be apparent to one of ordinary skill in the art that many modifications and variations are possible in view of the above teachings.

The Summary and Abstract sections may set forth one or more but not all exemplary embodiments of the present invention as contemplated by the inventors, and thus, are not intended to limit the present invention and the appended claims in any way.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The packages of the present invention may be manufactured using known materials and processes. The packaging materials may be virgin, recycled or a combination thereof. The volume within the package cavity can vary depending on the design selected.

Not all the features described herein need to be incorporated into every package, and those of skill in the art, using the teachings herein, can combine the features to provide a wide variety of improved contact lens packages. In summary, the contact lens packages of the present invention incorporate several novel functionalities which may be combined in a wide variety of combinations as described herein to provide the desired improved. The breadth and scope of the present invention should not be limited by any of the above-described exemplary embodiments but should be defined only in accordance with the following claims and their equivalents.

What is claimed is:

1. A contact lens package comprising:

a cavity that houses a contact lens and packaging solution, wherein an absolute pressure within the cavity is greater than standard atmospheric pressure when the package is in an unopened state.

2. The contact lens package of claim 1, wherein the absolute pressure within the cavity is greater than about 171 kPa when the package is in the unopened state.

3. The contact lens package of claim 1, wherein the absolute pressure within the cavity is within a range of about 171 kPa to about 601 kPa when the package is in the unopened state.

4. The contact lens package of claim 1, further comprising a base and a lid connected to the base, wherein the cavity is formed between the base and the lid.

5. The contact lens package of claim 4, wherein the base is flexible, and wherein the lid is flexible.

6. The contact lens package of claim 4, wherein the base comprises a foil layer, and wherein the lid comprises a foil layer.

7. The contact lens package of claim 4, wherein the base is substantially rigid, and wherein the lid is flexible.

8. The contact lens package of claim 4, wherein the lid extends over and covers the contact lens when the package is in the unopened state, wherein the lid does not cover the contact lens when the package is in an opened state, and wherein the contact lens is disposed within the cavity such that a convex surface of the contact lens faces the lid when the package is in the unopened state.

9. The contact lens package of claim 4, further comprising a lens support disposed within the cavity, wherein the lens support comprises a support surface that supports the contact lens within the cavity.

10. The contact lens package of claim 4, further comprising a lens support disposed within the cavity, wherein the support surface engages a concave surface of the contact lens.

11. The contact lens package of claim 4, further comprising a lens support disposed within the cavity, wherein the support surface is a convex surface.

12. The contact lens package of claim 4, further comprising a lens support disposed within the cavity, wherein the lid extends over and covers the lens support when the package is in the unopened state, and wherein the lid does not cover the lens support when the package is in an opened state.

13. The contact lens package of claim 4, further comprising a lens support disposed within the cavity, wherein the base is flexible, wherein the lid is flexible, and wherein the lens support is substantially rigid.

14. A method of packaging a contact lens, the method comprising:

disposing a contact lens and packaging solution within a cavity of the package;

creating a positive pressurize environment within the cavity such that an absolute pressure within the cavity is greater than standard atmospheric pressure; and enclosing the cavity such that the positive pressure environment is maintained within the cavity when the package is in an unopened state.

15. The method of claim 14, wherein the absolute pressure within the cavity is within a range of about 171 kPa to about 601 kPa when the package is in the unopened state.

16. The method of claim 14, wherein the package comprises a base and a lid connected to the base, wherein the cavity is formed between the base and the lid, and wherein enclosing the cavity comprises connecting the lid to the base.

17. The method of claim 16, wherein the contact lens is disposed within the cavity such that a convex surface of the contact lens faces the lid.

18. The method of claim 14, further comprising disposing a lens support within the cavity, wherein the lens support comprises a support surface that supports the contact lens within the cavity.

* * * * *